11/20/84 XR 4,484,188

United States Patent [19]

Ott

[11] Patent Number: 4,484,188

[45] Date of Patent: Nov. 20, 1984

[54] GRAPHICS VIDEO RESOLUTION IMPROVEMENT APPARATUS

[75] Inventor: Granville E. Ott, Lubbock, Tex.

[73] Assignee: Texas Instruments Incorporated, Dallas, Tex.

[21] Appl. No.: 371,041

[22] Filed: Apr. 23, 1982

[51] Int. Cl.[3] ..... G09G 1/02

[52] U.S. Cl. ..... 340/728; 340/733; 340/723; 358/11; 358/140

[58] Field of Search ..... 340/728, 741, 748, 750, 340/723, 733; 358/133, 136, 11, 140; 382/54, 55

[56] References Cited

U.S. PATENT DOCUMENTS

| | | | |
|---|---|---|---|
| 3,982,063 | 9/1976 | Brown et al. | 358/133 |
| 4,038,668 | 7/1977 | Quarton | 340/728 |
| 4,081,799 | 3/1978 | Granberg et al. | 358/133 |
| 4,193,092 | 3/1980 | Stoffel | 358/133 |
| 4,322,750 | 3/1982 | Lord et al. | 358/140 |
| 4,396,912 | 8/1983 | Pozzi | 340/728 |

FOREIGN PATENT DOCUMENTS

| | | | |
|---|---|---|---|
| 2640759 | 3/1978 | Fed. Rep. of Germany | 340/728 |

OTHER PUBLICATIONS

IBM Technical Disclosure Bulletin, vol. 19, No. 11, "Interleaved Smoothing Raster for Vector CRT Displays", Axford, Apr. 1977, pp. 4412–4414.

*Primary Examiner*—Gerald L. Brigance

*Attorney, Agent, or Firm*—Robert D. Marshall, Jr.; Leo N. Heiting; Melvin Sharp

[57] ABSTRACT

A video signal generation apparatus improves the resolution of the video signal by forming additional video scan lines between the successive scan lines by combining the video attributes of adjacent scan lines. This invention is particularly applicable to video display terminals and small computing systems which employ digital memories for storing graphic characters for display via a raster scan video display device. The graphics resolution may be improved in two dimensions by combining the techniques of averaging or smoothing a graphic character generated scan line by averaging or integrating a video attribute of the scan line over a period approximating the period of a individual picture element, together with forming new scan lines by combining the video attributes of adjacent graphic character generated scan lines. In a preferred embodiment of this invention an interlace scan system is formed using graphic character generated scan lines for the first half frame and the interpolated scan lines for the second half frame.

24 Claims, 6 Drawing Figures

GRAPHICS VIDEO RESOLUTION IMPROVEMENT APPARATUS

BACKGROUND OF THE INVENTION

This invention is most applicable to video display terminals or small computing systems which generate a video display based upon a set of digital graphic characters stored in memory. A typical system of this type would employ a video screen resolution of about 256×192 individual picture elements or pixels. Assuming that a one bit code is assigned to each picture element, that is whether the picture element is one (white) or off (black), then approximately 6K bytes of memory would be required for complete storage of one screen. This storage requirement would be substantially increased in the case in which a color video display is desired. Typically, eight or sixteen different colors are available in a color video display thereby multiplying the memory requirement for complete storage of one screen by a factor of three, in the case of a selection of eight different colors, or four for the case of a selection of sixteen different colors. Thus a 256×192 picture element system employing a choice of sixteen colors would require approximately 24K bytes of memory.

A screen resolution of 256×192 picture elements is typically below the resolution that an ordinary television set or video monitor can display. The screen resolution ordinarily found in a good quality television broadcast system is approximately 512×384 picture elements. In order to completely store graphic signals for a sixteen color system of this resolution approximately 96K bytes of memory capacity would be necessary. This amount of memory capacity greatly exceeds the amount of random access memory typically provided in video display terminals or small computing systems of this type.

In order to overcome this requirement for a large amount of memory in order to present graphic characters, video display terminals and small computing systems of this type typically utilize several techniques. Firstly, the screen in these systems is typically provided with only approximately 256×192 picture elements of resolution. This picture resolution is provided by quantatizing the minimum length of time for each picture element within each scan line, thereby providing a horizontal resolution of approximately 256 picture elements. In addition, it is not typical to employ an interlace scan in such systems. This is, each video frame has 192 scan lines and each of these scan lines are transmitted sequentially from the top to the bottom of the display. This is different from the television broadcast techniques most often used, particularly this is different from the NTSC standard employed in the United States and Japan and PAL standard most commonly employed in Europe. Under these systems, the video frame is scanned in two half frames. These two half frames include a first half frame in which the scan signals for the odd number scan lines are transmitted and a second half frame in which the scan signals for the even number scan lines are transmitted. In addition, a video display terminal or small computing system of this type typically would employ a finite set of graphic character words to define the picture video attributes of a group of picture elements. Typically one graphic character would define the video attributes of an 8×8 group of picture elements. Then the screen would be defined by a listing of the addresses within the memory where the graphic character words for the particular screen are stored.

Even with the use of such memory reduction techniques, typically such a video display terminal or small computing system must make a trade-off between the amount of memory space employed and the video resolution generated. The compromise is most often struck in the favor of limited memory and limited screen resolution. This results in a problem of a jagged "staircase" edger on diagonal lines. This "staircase" type diagonal line typically provides a less attractive video display than if such lines could be smooth.

OBJECT OF THE INVENTION

It is an object of the invention to provide an apparatus for generating a video display with high apparent resolution which requires a minimum of graphic character memory. This object is accomplished by generating new scan lines for positions between the graphic character generated scan lines, these new scan lines having video attributes which represent a combination of the video attributes of the adjacent graphic character generated or real scan lines.

It is another object of the present invention to provide a apparatus for improving the apparent resolution of a video display in two dimensions simultaneously. This object is accomplished by a combination of integrating or averaging the graphic character generated scan lines in order to provide intermediate values of the video attributes between the values generated by the graphic characters and by generating intermediate scan lines which have video attributes which are formed by combining the video attributes of the averaged or integrated scan lines.

It is a further object of the present invention to provide an interlace scan system and video display graphics for video display terminals and small computing systems. This interlace scan system is formed by generating a first half frame scan formed from the averaged or integrated real scan lines on odd numbered scan line positions within the video frame and by forming the second half frame of interpolated scan lines formed by combining the video attributes of adjacent integrated real scan lines in the even numbered scan line positions within the frame.

BRIEF DESCRIPTION OF THE DRAWINGS

These and other objects and attributes of the present invention will be explained in detail in the accompanying description of the invention taken in conjunction with the figures in which.

DETAIL DESCRIPTION OF THE PREFERRED EMBODIMENT

Figure 1:
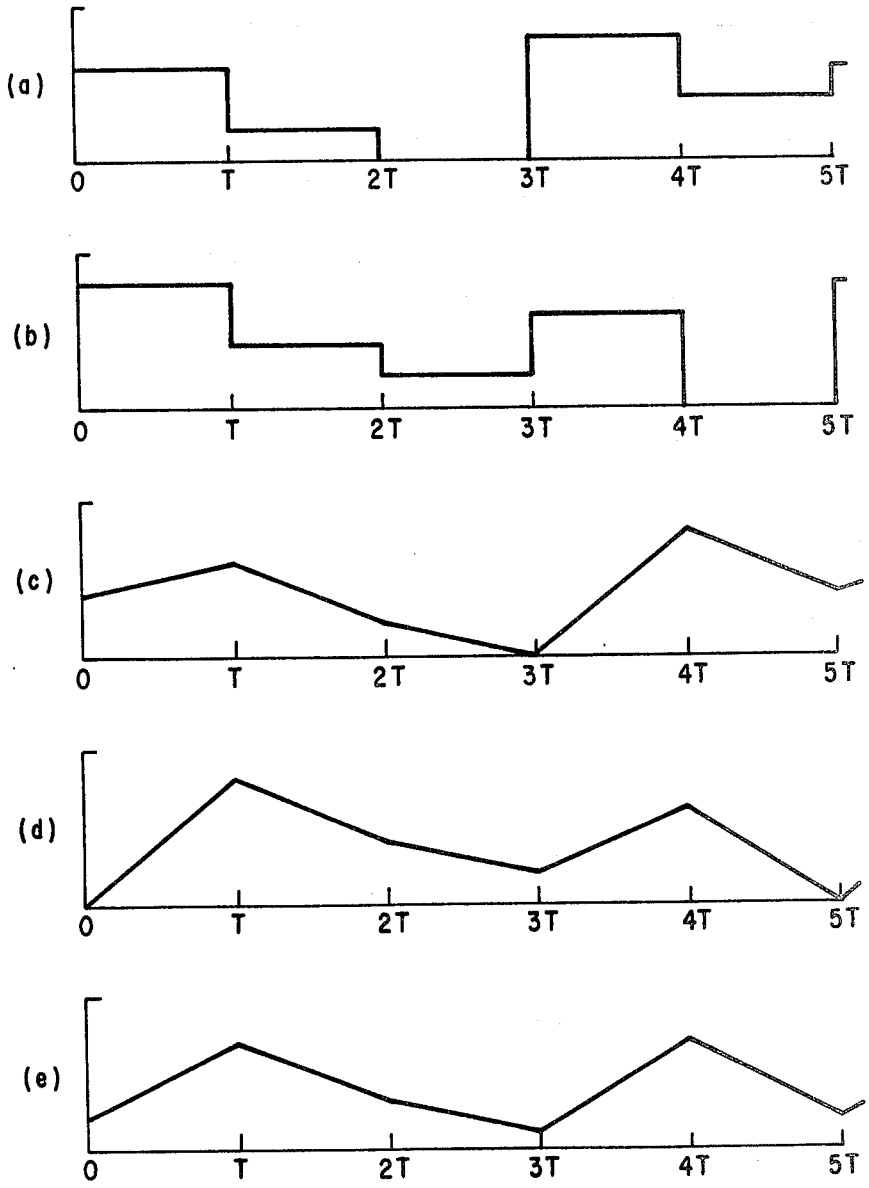
FIGS. 1(*a*) to (*e*) illustrates hypothetical scan line signals which are generated at various portions within the present invention.

FIGS. 1(*a*) and 1(*b*) illustrate a portion of the signal corresponding to one video attribute within adjacent scan lines. In a monochromic video display system the only video attribute is brightness or intensity. In a color video system there will be at least three video attributes, one corresponding to each of the three primary colors. In some systems, however, the intensity or brightness is one video attribute and a red color difference signal and a blue color difference signal provide the other two video attributes. The red primary color signal is obtained by adding the red color difference signal to the brightness signal and the blue primary color signal is obtained by adding the blue color difference signal to the brightness signal. The third primary color signal, in this case green, is obtained from a weighted combination of the brightness signal, the red color difference signal and the blue color difference signal. This relationship holds because the combination of the three primary color signals, red, blue and green equal the brightness signal.

A study of the character word generated scan line signals illustrated in FIGS. 1(*a*) and 1(*b*) shows immediately that these signals are quantized in both magnitude and time. That is, the signals can achieve only a limited number of magnitude states and that the signals change only at predetermined intervals of time. Thus each of these signals remains unchanged for each of the intervals from 0 to T, T to 2T, 2T to 3T and so forth. Such quantization in time leads to a relatively limited resolution in the horizontal dimension.

A first step in improving the resolution of the scan signals appearing in FIGS. 1(*a*) and 1(*b*) is averaging or intergrating over a period related to the interval T. FIG. 1(*c*) illustrates the result of such an averaging over the scan signal illustrated in FIG. 1(*a*). Similarly, FIG. 1(*d*) illustrates the results of averaging over the scan signal illustrated in FIG. 1(*b*). In the case of the signals illustrated in FIGS. 1(*c*) and 1(*d*), the constant of integration has been selected in order that the integrated value at the end of each time period is closely approximate to the quantized value of the original signal. This result may be achieved by setting the time constant of integration to approximately one third of the quantization interval T.

FIG. 1(*e*) illustrates the signal characteristics of an interpolation scan line, that is a scan line which is formed by combining the characteristics of the scan lines illustrated in FIGS. 1(*c*) and 1(*d*). The signal illustrated in FIG. 1(*e*) is formed by taking the average of the signals appearing in FIGS.1 (*c*) and 1(*d*). This averaging requires that both the signals of FIGS. 1(*c*) and 1(*d*) be available at the same time for application to a summing amplifier circuit. This may be achieved by delaying the oldest scan line for a period equal to the length of time taken for one scan line interval. This delayed signal is then applied to a summing amplifier circuit in conjunction with the current scan line signal. The details of the manner in which this is accomplished are explained below.

Figure 2:
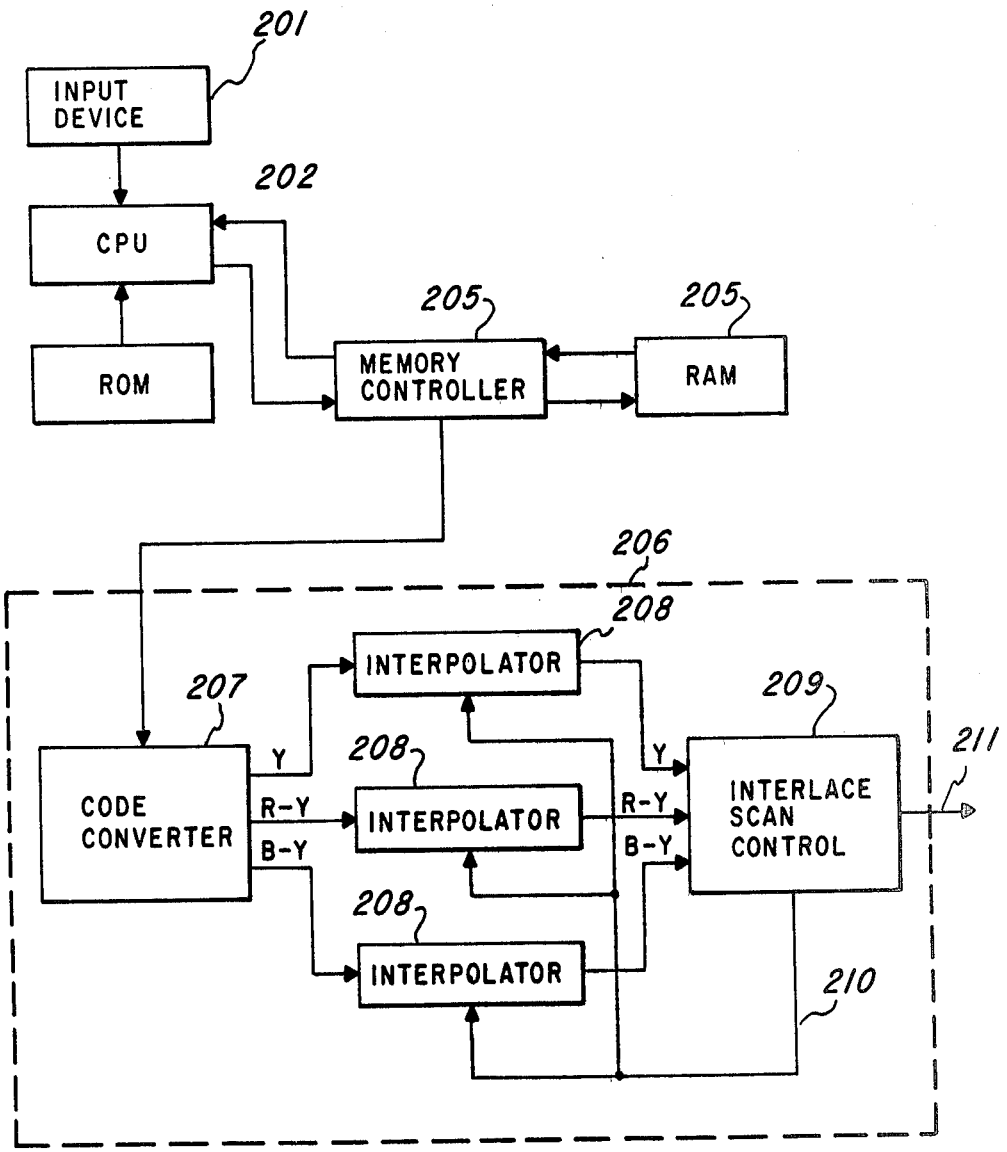
FIG. 2 illustrates a block diagram of a video display terminal or small computing system of the type employed in the present invention, which particularly illustrates the video signal generator.

FIG. 2 illustrates a block diagram of a video display terminal or small computer system which employs the present invention. The computing system 200 includes input device 201, central processing unit 202, read only memory 203, random access memory 204, memory controller 205, and video signal generator 206. Operator instructions and data inputs are provided through input device 201. These signals are applied to central processing unit 202, which is also responsive to program instructions stored within read only memory 203. In accordance with the program instructions within read only memory 203 and in accordance with input signals received from input device 201, central processing unit 202 performs various data processing functions. These data processing functions typically will require interaction with random access memory 204. Random access memory 204 is employed for temporary storage of user programs, intermediate data and other forms of temporary data. Central processing unit 202 typically interacts with random access memory 204 through a memory controller 205. Memory controller 205 provides the proper signals for addressing random access memory 204 for writing data into and recalling data from random access memory 204 and also provides proper format for application of this data to central processing unit 202. Memory controller 205 is also provided to apply data in the proper sequence to video signal generator 206 for generation of the video signal for visual diplay to the operator.

Video signal generator 206 includes code converter 207, a plurality of interpolators 208 and an interlace scan control 209. Code converter 207 receives data from memory controller 205. This data is provided in the form of sequential graphic character words for the scan lines of the video display. Code converter 207 takes these graphic character words and generates a plurality of video attributes corresponding to these words. As illustrated in FIG. 2, code converter 207 generates a brightness signal (Y), a red color difference signal (R−Y) and a blue color difference signal (B−Y). This set of signals is sufficient to generate color graphics on the video display. It should be understood that three primary color intensity signals such as a red color intensity signal, a blue color intensity signal and a green color intensity signal could also be generated for complete specification of a color display. In addition, in the case of a monochromic display a single brightness signal would be generated by code converter 207. Each of the signals generated by code converter 207 is applied to an interpolator 208. The operation of interpolator 208 will be further described below. Each interpolator 208 provides an averaging or integration of the scan signal applied thereto and further includes a one scan line delay device which enables generation of an interpolation scan line. The signals from the three interpolators are each applied to interlace scan control 209. Interlace scan control 209 provides control signals and color modulation signals in order to generate a composite video output at 211. In addition, interlace scan control 209 generates a switching signal at 210 which is applied to each of the interpolators 208. As will be further described below, this switching signal determines whether the interpolator 208 provides an averaged real scan line signal or an interpolation scan line signal.

Figure 3:
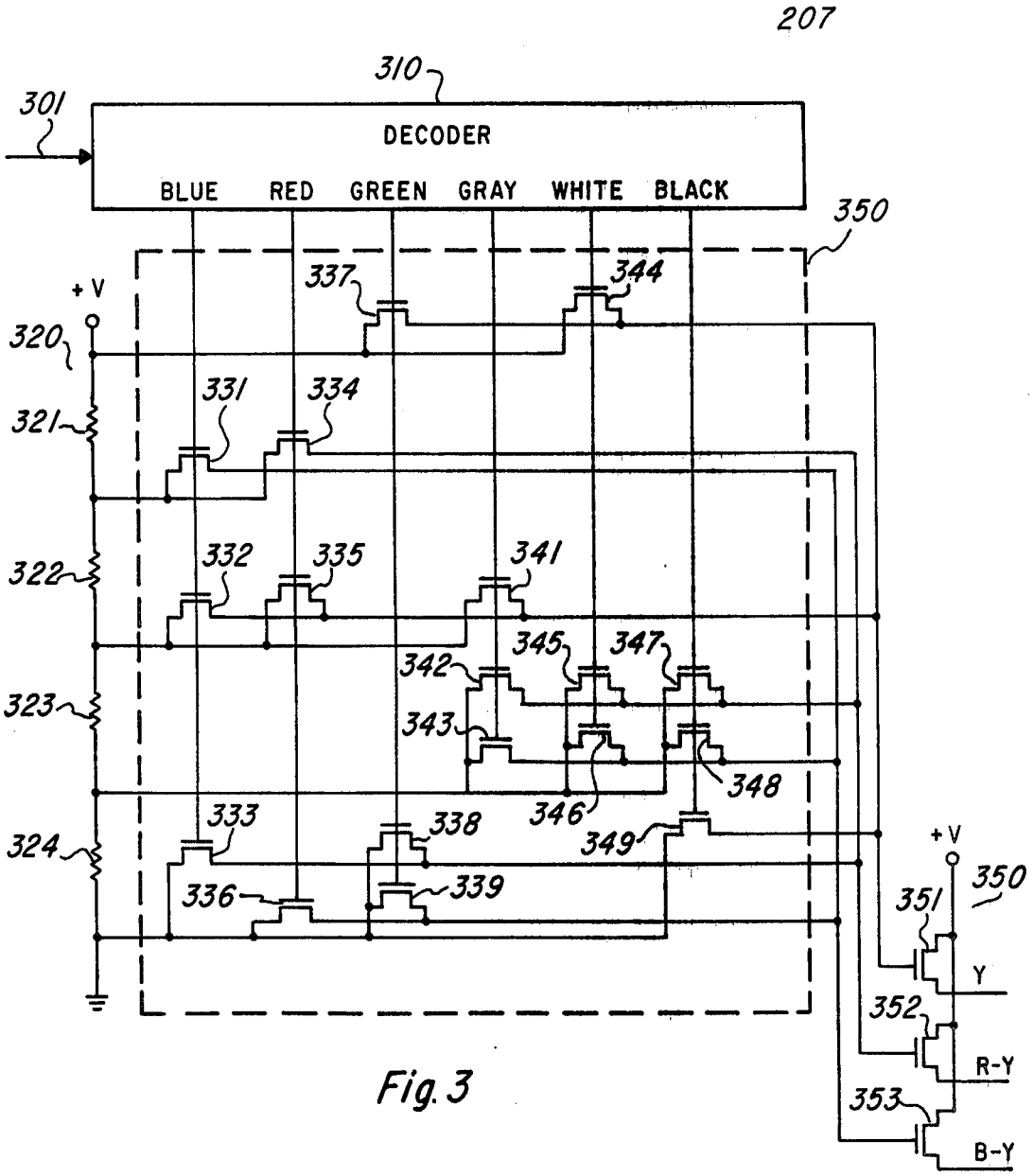
FIG. 3 provides a detail illustration of the code converter illustrated in FIG. 2.

FIG. 3 illustrates a preferred embodiment of the code converter 207 illustrated in FIG. 2. Code converter 207 includes decoder 310, voltage reference circuit 320, switching circuit 330 and output circuit 350.

Decoder 310 receives the digital character input from memory 205 on line 301. This input on line 301 preferrably includes sequential multibit graphic character words. Decoder 310 receives each multibit graphic character word and generates an output on one of a plurality of output lines. In the particular embodiment illustrated in FIG. 3 decoder 310 involves a one of six select and generates an output on one of the lines marked blue, red, green, gray, white or black. The details of decoder 310 are entirely conventional and operates according to principles well known to those skilled in the art. It could also be noted that the illustrated decoder 310 which generates an output on one of six output lines represents a convenient choice for illustration of the principles of this invention. It will be readily apparent to those skilled in the art that the decoder 310 could be designed to operate on a number of different graphic character codes to generate one output of a predetermined number of outputs differing from six. In accordance with the examples described earlier, it is within the contemplation of the invention that a 4 bit character code received on line 301 would enable decoder 310 to generate an output on one of sixteen different output lines.

Voltage reference 320 includes a voltage divider circuit connected between a positive voltage and ground. This voltage divider circuit includes resistors 321, 322, 323 and 324. Thus reference voltage source 320 enables generation of voltages at a plurality of discrete levels by tapping the nodes between the resistors 321 to 324. As will be clearly understood by those skilled in the art, it may be desirable to provide a smaller number or a greater number of resistors within reference voltage source 320 in order to generate the specific voltages desired according to the particular selected video attributes.

Switching circuit 330 receives inputs from the six outputs of decoder 310 and further receives the reference voltages from reference voltage source 320. In accordance with the particular output actuated from decoder 310, switching circuit 330 applies voltages obtained from reference voltage source 320 to the output circuit 350. For example, in the case in which the blue output of decoder 310 is actuated field effect devices 331, 332, 333 are actuated. Actuation of these devices applies predetermined voltages obtained from reference voltage source 320 to the output circuit 350. A voltage obtained from the node between resistor 321 and 322 is applied to the blue difference signal field effect device 353 through field effect device 331. Similarly, the output voltage from the node between resistors 322 and 323 is applied via field effect device 332 to brightness signal field effect device 351. Lastly, a ground voltage is applied through field effect device 353 to red difference signal field effect device 352. Similarly, actuation of the red output of decoder 310 actuates field effect devices 334, 335, and 336 thereby applying predetermined voltages from reference voltage source 320 to field effect devices 352, 351 and 353, respectively. As manner similar to that described above, each of the green, gray, white and black output terminals from decoder 310 actuates three field effect devices which apply specific reference voltages from reference voltage source 320 to the output circuit 350. In this manner, each of the outputs from decoder 310 causes application of three voltage signals to the output circuit 350, these voltages corresponding to particular video attributes.

Output circuit 350 includes brightness signal field effect device 351, red difference signal field effect device 352 and blue difference signal field effect device 353. As previously explained, switching circuit 330 applies predetermined voltages to the gates of each of the field effect devices 351, 352 and 353 depending upon the particular output from decoder 310. Note that switching circuit 330 has been constructed so that one and only one voltage reference signal from reference voltage source 320 is applied to each of the gates of field effect devices 351, 352 and 353. In accordance with the pattern of gates provided in switching circuit 330, this particular voltage corresponds to the video attributes for the particular color output from decoder 310. Output circuit 350 serves as a buffer circuit for applying these voltage reference signals to the interpolators 208 illustrated in FIG. 2, Although code converter 207 illustrated in FIG. 3 has been constructed to generate a brightness signal and two color difference signals, it would be readily apparent to those skilled in the art that this circuit could be equally applicable for generation of three primary color intensity signals. Conversions to a circuit which generates three primary color intensity signals would require realignment of the field effect devices provided in switching circuit 330. Thus instead of coupling voltage points from reference voltage source 320 corresponding to the brightness and the two color difference signals, the field effect devices attached to each output of decoder 310 would instead provide voltages corresponding to the three primary color intensity signals. However, this alternate design choice in no way alters the basic principles of the present invention.

Figure 4:
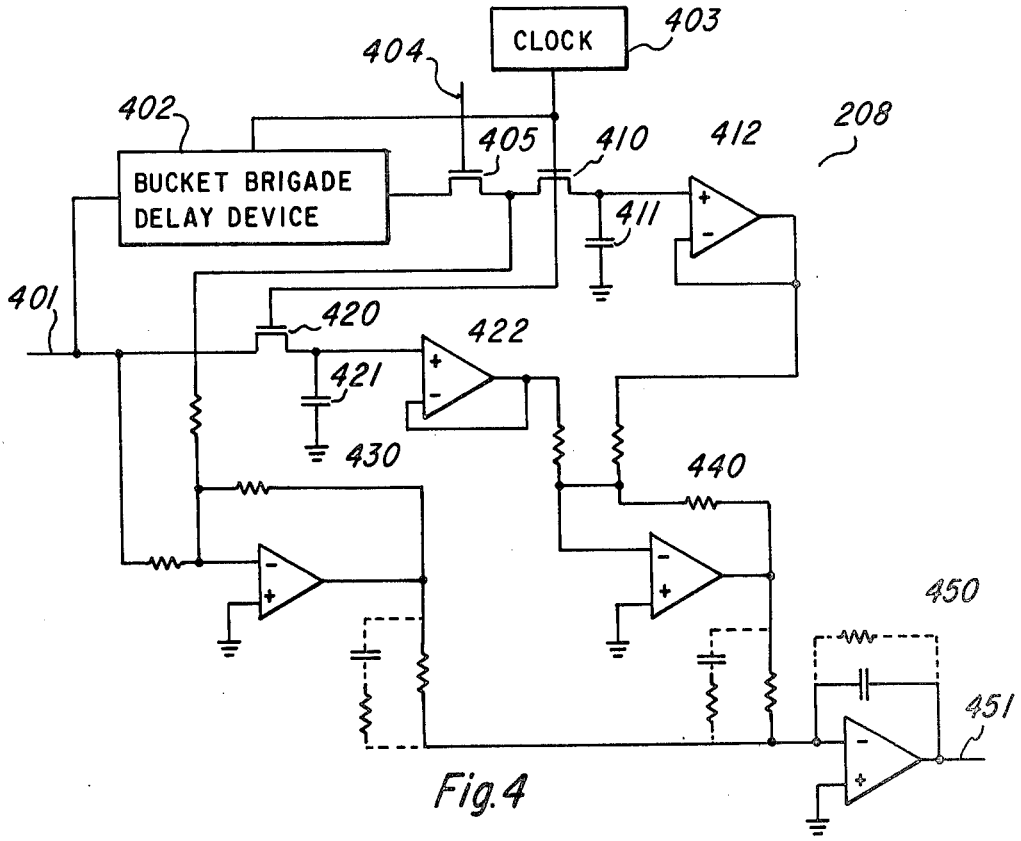
FIG. 4 illustrates one embodiment of the interpolator illustrated in FIG. 2.

FIG. 4 illustrates one embodiment of interpolator 208 illustrated in FIG. 2. Interpolator 208 consists primarily of bucket brigade delay device 402, a pair of sample and hold circuits, a pair of summing amplifiers and an integrating summing amplifier. Note according to FIG. 2 that there are a plurality of interpolators 208 within video signal generator 206. Each interpolator 208 is connected to one of the video attribute outputs from code converter 207. For the sake of simplicity, FIG. 4 illustrates only one of interpolators 208 which preferably are formed of identical circuits.

Interpolator 208 receives the video attribute output signal from code converter 207 on line 401. Line 401 branches to two paths. A first path is applied to summing amplifier 430 and switch device 420, whose purpose will be explained in further detail below. The other path is applied to bucket brigade delay device 402. Bucket brigade delay device 402 serves as an analog delay line for delaying signals applied at line 401 for a period equal to the time of one complete scan line. Such a bucket brigade delay device can be embodied in a charge coupled device which has a plurality of charge wells. Each of these charge wells serves as a analog storage device, the analog signal depending upon the amount of charge stored therein. These charge wells are coupled together in a line called a bucket brigade with clocked gates. A clock source, such as clock source 403, controls the transfer of charge from one charge well to another, thus controlling the transfer of a sampled analog signal between particular charge wells. The total delay of such a charge coupled device depends upon the clock rate and the number of charge wells within the bucket brigade line. Such charge coupled devices for delay equal to one scan period are standard devices which are commercially available.

The output of bucket brigade delay device 402 is applied to field effect device 405 which serves as a switch. Field effect device 405 receives a signal on line 404 from interlace scan control 209 in a manner which will be more fully explained below. However, depending upon the state of the signal on line 404, field effect device 405 behaves either as an open or a closed switch.

Summing amplifier 430 receives a video attribute signal directly on line 401 and a delayed video attribute signal from bucket brigade delay device 402 through field effect device 405. Summing amplifier 430 generates an output which corresponds generally to the sum of the two inputs in a manner which will be clearly understood by those skilled in the art.

The delayed video attribute signal from bucket brigade delay device 402 and the current video attribute signal on line 401 are applied to respective sample and hold devices. Clock 403 is applied to the gate of field effect devices 410 and 420, which act as either open or closed switches. When field effect device 410 is conducting the output from bucket brigade delay device 402 is stored in capacitor 411. Similarly, when field effect device 420 is conducting the video attribute signal received on line 401 is applied to and stored in capacitor 421.

Note that clock 403 is illustrated as applied to bucket brigade delay device 402 as well as field effect devices 410 and 420. By proper choice of the frequency of clock 403 together with the number of storage elements within bucket brigade delay device 402, one clock pulse signal from clock 403 may correspond to the length of time of one picture element or pixel, such as the time interval T illustrated in FIG. 1. Depending upon the number of separate elements within bucket brigade delay device 402, it may be necessary to apply a different clock frequency to bucket brigade device 402 than applied to field effect devices 410 and 420. However, these differing frequency signals must be phase related in order to insure the proper relationship between the output of bucket brigade delay device 402 and the conducting time of field effect device 410.

Voltage follower amplifier 412 serves to generate an output having a voltage equal to the voltage across capacitor 411, without significantly loading or discharging this capacitor. Similarly, voltage follower amplifier 422 generates a voltage signal corresponding to the voltage stored in capacitor 421. The outputs of voltage follower amplifiers 412 and 422 are applied to separate inputs of summing amplifier 440. Summing amplifier 440 operates in a manner similar to summing amplifier 430 to generate an output corresponding to the signals applied to its respective inputs.

The outputs of summing amplifiers 430 and 440 are applied to respective inputs of integrating summing amplifier 450. Integrated summing amplifier 450 generates an output signal which is a time averaged or integrated sum of the outputs of summing amplifiers 430 and 440. This output at line 451 is then applied to interlace scan control 209 in the manner illustrated in FIG. 2. Note that the capacitor employed in integrating summing amplifier 450 must have a capacitance selected in relation to the length of time of a picture element or pixel. As explained above, the capacitor is preferrably selected so that the time constant of integrating summing amplifier 450 is approximately one third of the picture element period in order to ensure that the output at line 451 is close to the undelayed video attribute signal applied to line 401 at the end of the picture element period.

In the event that a different waveshape other than that illustrated in FIGS. 1(*c*)–1(*e*) is desired, additional circuitry such as illustrated by dashed lines may be added to integrating summing amplifier 450. A feedback resistor may be placed in parallel with the feedback capacitor to add some gain component to the output at line 451. This serves to generate an exponential type rise and fall. Under certain circumstances it may be desirable to implement some sort of derivative component in integrating summing amplifier 450. This technique, called prepeaking, is achieved by providing a series combination of a resistor and a capacitor in parallel with one or both of the input resistors. In the case of a code converter 207 such as illustrated in FIG. 3 which generates sharp state transistors such as illustrated in FIGS. 1(*a*) and 1(*b*) such prepeaking would be undesirable. However, if for some reason the state transistions were significantly degraded, such as if bucket brigade delay device 402 tended to integrate the picture element signals thereby degrading the sharp transistions, prepeaking may be desirable. The essential feature is that interpolator 208 provide a desired combination of the video attribute signals.

The overall operation of interpolator 208 will now be detailed. The signal from interlace scan control 209 on line 404 causes field effect device 405 to be nonconductive during the time in which interpolation scan lines are not formed. Thus the output signal from bucket brigade delay device 402 is not applied to summing amplifier 430 nor is it applied to the sample and hold circuit including field effect device 410, capacitor 411 and voltage follower amplifier 412. The output from summing amplifier 430 is therefore solely dependent upon the input video attribute signal on line 401. The output of voltage follower amplifier 422 corresponds to the video attribute signal on line 401 sampled at a time during the previous picture element interval. The signal from bucket brigade delay device 402 is interrupted by the nonconductive field effect device 405, therefore voltage follower amplifier 412 does not generate an output signal. Thus the input to summing amplifier 440 is solely dependent upon the output of voltage follower amplifier 422. The inputs to integrating summing amplifier 450 are therefore the current voltage attribute signal on 401 from summing amplifier 430 and a delayed signal corresponding to the video attribute signal of the previous picture element from summing amplifier 440. Thus integrating summing amplifier 450 generates an averaged or integrated signal such as illustrated in FIGS. 1(*c*) and 1(*d*). This corresponds to an average signal for increasing the horizontal resolution of the video display.

During the time in which an interpolated scan line is generated, the signal from interlace scan control 209 appearing on line 404 causes field effect device 405 to be conducting. Therefore, summing amplifier 430 receives the undelayed video attribute signal from line 401 and the one scan line period delayed signal from bucket brigade delay device 402. These two signals are summed by summing amplifier 430 and applied to one input of integrating summing amplifier 450. Similarly, the one picture element delayed signals from the respective sample and hold devices are applied to inputs of summing amplifier 440. Summing amplifier 440 sums these signals and applies an output corresponding to this sum to one input of integrating summing amplifier 450. Integrating summing amplifier 450 thus generates an output at line 451 which corresponds to a signals of the type illustrated in FIG. 1(*e*). This signal is the average of a video attribute for successive scan lines and successive picture elements within each scan line.

Figure 5:
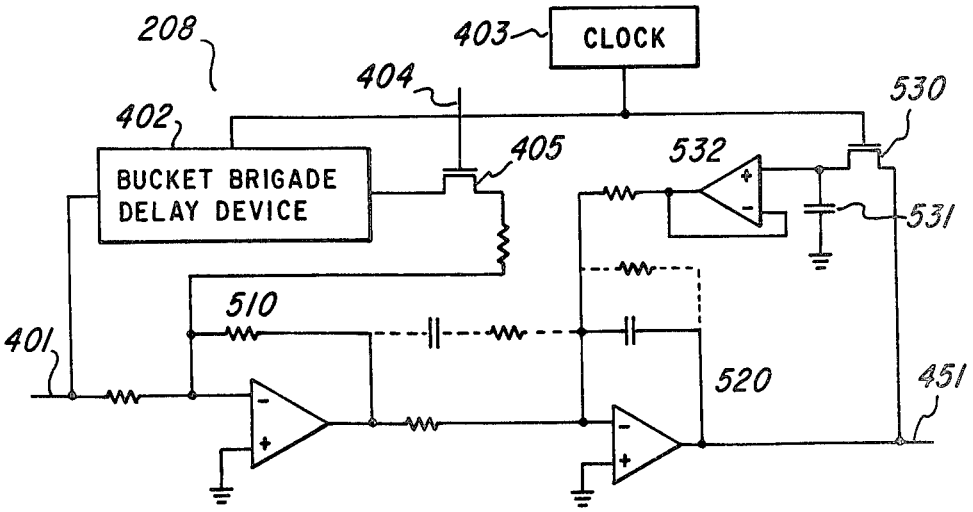
FIG. 5 illustrates an alternative embodiment of the interpolator illustrated in FIG. 2.

FIG. 5 illustrates an alternative embodiment of interpolator 208 illustrated in FIG. 3. FIG. 5 includes bucket brigade delay device 402, summing amplifier 510, summing integrator 520 and a sample and hold device including field effect device 530, capacitor 531 and voltage follower amplifier 532. The circuit illustrated in FIG. 5 advantageously employs fewer components than the circuit illustrated in FIG. 4 while performing essentially the same functions. The input video attribute signal is applied on line 401 as in the case of the circuit illustrated in FIG. 4. This input signal is applied to one input of summing amplifier 510. This input signal is also applied to the input of bucket brigade delay device 402. Bucket brigade delay device 402 applies an output to field effect device 405 which is controlled by a signal from line 404 in a manner fully explained above in conjunction with the description of FIG. 4. The output of bucket brigade delay device 402, as gated by field effect device 405, is applied to a second input of summing amplifier 510. The output of summing amplifier 510 is applied to one input of integrating summing amplifier 520 in a manner similar to that illustrated in FIG. 4.

As in the case of integrating summing amplifier 450 illustrated in FIG. 4, it may be desirable to provide integrating summing amplifier 520 with a gain component or a prepeaking component such as illustrated in the dashed lines.

The circuit illustrated in FIG. 5 achieves the one picture element delay for both the real scan lines and the interpolated scan lines in a different manner that that illustrated in FIG. 4. The output of integrating summing amplifier 520 is applied to a sample and hold circuit which includes field effect device 530, capacitor 531 and voltage follower amplifier 532. Field effect device 530 operates as a switch and is controlled by the signal from clock 403 in a manner similar to the control of field effect devices 410 and 420 illustrated in FIG. 4. When field effect device 530 is conductive, capacitor 531 is charged to the output voltage of integrating summing amplifier 520. Voltage follower amplifier 532 provides an output voltage proportional the voltage stored on capacitor 531 without significantly loading or discharging this capacitor. The output of voltage follower amplifier 532 is applied to a second input of integrating summing amplifier 520. The sample and hold circuit thus provides the one picture element delay previously provided by two separate structures illustrated in FIG. 4. In other respects the interpolator illustrated in FIG. 5 operates analogously to the interpolator illustrated in FIG. 4.

Figure 6:
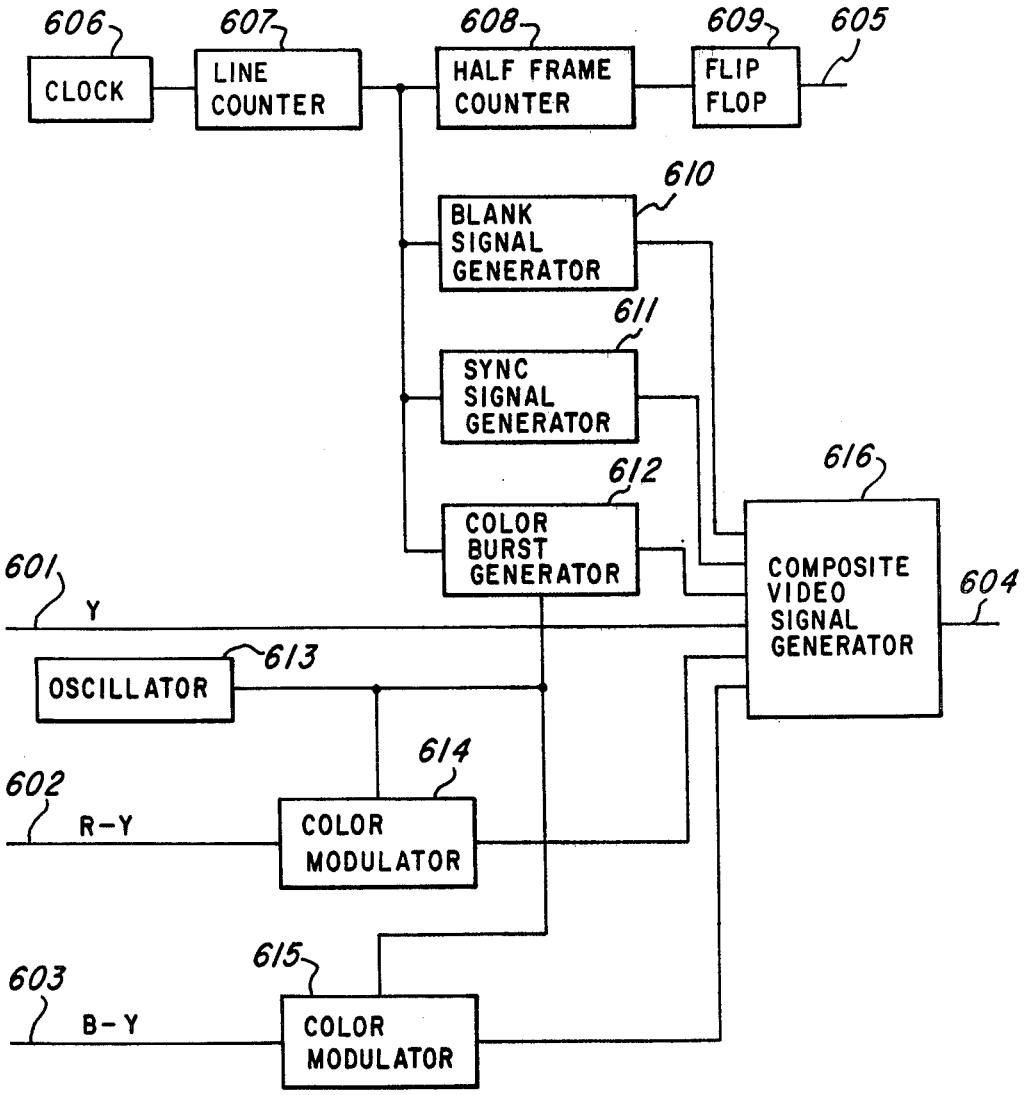
FIG. 6 illustrates an embodiment of the interlace scan control illustrated in FIG. 2.

FIG. 6 illustrates a block diagram of the interlace scan control 209 illustrated in FIG. 2. Interlace scan control 209 receives signals from the respective interpolators 208 on lines 601, 602 and 603. In accordance with the system illustrated in FIG. 2, 601 is designated the brightness signal line, 602 is designated the red color difference line and 603 is designated the blue color difference line. Interlace scan control 209 generates a composite video output signal on line 604 and generates an interpolator control signal on line 605. The primary function of interlace scan control 209 is to provide proper control signals and signal conditioning upon the video attribute signals in order to generate a composite video signal. This composite video signal can then be applied directly to a monitor in order to generate the video display or may be applied to an RF frequency modulator in order to generate a standard television signal for display on a standard television receiver.

The control signal generation portion of interlace scan control 209 begins with clock 606. Clock 606 is preferrably phase synchronized with the clocks 403 of interpolators 208 in order to provide the proper timing of the control signals generated by interlace scan control 209. The output of clock 606 is applied to line counter 607 which generates an output once per scan line period by counting the pulses coming from clock 606. This once per scan line period signal is applied to half frame counter 608, blank signal generator 610, sync signal generator 611 and color burst generator 612. Half frame counter 608 counts the scan line period signals from line counter 607 to determine when to switch between generating real scan lines and generating interpolated scan lines. According to the NTSC television transmission standard each frame includes two hundred sixty two and one half scan lines. According to the PAL transmission standard each frame includes three hundred twelve and one half scan lines. Half frame counter 608 counts half the total number of scan lines in order to provide a pulse for toggeling flip flop 609. The output from flip flop 609 is applied to line 605 (corresponding to line 210 illustrated in FIG. 2) and thus applied to each of the interpolators 208. This signal is applied to lines 404 illustrated in FIGS. 4 and 5 in order to control whether the signal from bucket brigade delay device 402 is applied to the remaining circuitry of the respective interpolators 208. When flip flop 609 applies a signal to the field effect device 406 to make it nonconductive then interpolators 208 generate real scan lines according to the graphic character words applied to video signal generator 206 from memory controller 205. When flip flop 609 causes field effects devices 405 to be conductive, then the interpolators 208 generate interpolated scan lines caused by summing and averaging between adjacent scan lines, a scan line just received and a scan line delayed through bucket brigade delay device 402. If it has not already been clear it should be specifically noted here that this system requires that memory controller 205 recall graphic character words from a RAM 204 and apply them to video signal generator 206 twice for each complete screen in the video display. In the first instance video signal generator 206 generates real scan lines, i.e. these scan lines correspond directly to the data stored in RAM 204 and applied to the video signal generator 206 from memory controller 205 including only the attribute smoothing. During the second application of the graphic character codes from memory controller 205 to video display processor 206, video display processor 206 generates interpolation scan lines, which are placed on the video screen in positions which alternate with the positions at which the real scan lines were placed.

The application of the signal from line counter 607 to blank signal generator 610 causes blank signal generator 610 to generate a video blanking signal which places the composite video signal in a specific state when no video attribute signals are generated. These time periods occur during the horizontal retrace interval, during which the cathode ray beam in the particular video display employed is returned to the left most portion of the screen to begin to write a new scan line on the screen and during the vertical blanking period during which the cathode ray beam is returned to the upper left hand portion of the screen to begin writing a new screen.

Similarly, application of the signal from line counter 607 actuates sync signal generator 611. Sync signal generator 611 generates a horizontal sync signal prior to the start of each video scan line. This horizontal sync signal is employed in the monitor or receiver in order to properly align horizontal scan lines. The signal from line counter 607 is also applied to color burst generator 612 which operates in a manner which will be further described below.

The brightness signal appearing on line 601 is applied directly to composite video signal generator 612. Each of the color difference signals, are applied to color modulators in order to generate the required signal for the particular transmission encoding technique employed. Oscillator 612 generates a signal which is applied to color modulator 614, color modulator 615 and color burst generator 612. The particular frequency employed depends upon the transmission standard selected. In the NTSC encoding system the frequency standard is approximately 3.58 MHz. In the PAL encoding system the frequency standard is approximately 4.43 MHz. In the PAL encoding system the phase of the color information alternates for alternating video lines. Thus for a system which operates in accordance with the PAL encoding system a signal must be applied to oscillator 613 in order to alternate the phase of the frequency standard depending upon the particular line. This may be easily accomplished by applying a signal from line counter 607 to a phase control device at the output of oscillator 613. The particular interlace scan control 209 illustrated in FIG. 6 is designed to operate in accordance with the NTSC standard, in which no such phase control is required, However, it should be understood that provision of such phase control could be easily accomplished employing techniques well known in the art.

The standard frequency signal from oscillator 613 is applied to color modulator 614 and color modulator 615. Color modulator 614 modulates the red color difference signal appearing on line 602 into the standard frequency signal required for the composite video signal. Similarly, color modulator 615 modulates the blue color difference signal appearing on line 603 into the proper form for the composite video signal. In addition, the standard frequency signal from oscillator 613 is also applied to color burst generator 612. Color burst generator 612 generates a color burst signal at the beginning of each scan line which is employed by the monitor or TV receiver for phase synchronization of an internal color signal oscillator. This phase synchronization is necessary for proper demodulation of the modulated red and blue color difference signals. This color burst signal is generated for a short period at the beginning of each scan line, this time being determined by the pulse signal from line counter 607.

Composite video signal generator 616 receives a blanking signal from blank signal generators 610, a sync signal from sync signal generator 611, a color burst signal from color burst generator 612, a brightness signal from line 601, a modulated red color difference signal from color modulator 614 and a modulated blue color difference signal from color modulator 615. Composite video signal generator 612 sums these seperate signals with appropriate weighting and level correction and generates a composite video signal output on line 604.

Although the present invention has been described in conjunction with particular preferred embodiments, those skilled in the art will readily understand that the invention may be employed in manners different from the particular embodiments described. The essential feature of the present invention is the generation of interpolation scan lines by combining the video attributes of adjacent independently generated video scan lines. This technique may be used to improve the horizontal resolution by smoothing or averaging the independently generated video scan lines and to improve the vertizal resolution by generation of interpolation scan lines for presentation in an interlace frame between the positions of the independently generated video scan lines.

What is claimed is:

1. A video signal generator comprising:

a scan line generating means for repretitively generating video scan lines having a predetermined scan line period including a plurality of picture elements, each picture element having a predetermined picture element period and at least one video attribute;

a delay means connected to said scan line generating means for delaying video scan lines for one scan line period;

an interpolation means connected to said scan line generating means and said delay means for repetitively generating interpolation scan lines by generating picture elements having at least one video attribute formed by summing and time integrating said at least one video attribute of a picture element of a video scan lines and said at least one video attribute of a corresponding picture element of a delayed video scan line from said delay means; and a video signal combining means connected to said scan line generating means and said interpolation means for generating a combined video signal including said video scan lines and said interpolation scan lines.

2. A video signal generator as claimed in claim 1, wherein said at least one video attribute includes brightness.

3. A video signal generator as claimed in claim 2, wherein:

said at least one video attribute further includes a first color difference signal and a second color difference signal; and said interpolation means repetitively generates interpolation scan lines by separately summing and time integrating said brightness, said first color difference signal and said second color difference signal of a picture element of video scan lines from said scan line generating means and a corresponding picture element of video scan lines from said delay means.

4. A video signal generator as claimed in claim 1, wherein said at least one video attribute includes at least one primary color intensity.

5. A video signal generator as claimed in claim 4, wherein:

said at least primary color intensity includes a first primary color intensity, a second primary color intensity and a third primary color intensity, and said interpolation means repetitively generates interpolation scan lines by separately summing and time integrating said first primary color intensity, said second primary color intensity and said third primary color intensity of a picture element of video scan lines from said scan line generating means and a corresponding picture element of video scan lines of said delay means.

6. A video signal generator as claimed in claim 1, wherein:

said scan line generating means generates a first set of a predetermined number of video scan lines corresponding to a single video frame and then repeats generation of said first set of video scan lines; and said video signal combining means generates a first interlace frame signal for placing said first set of video scan lines in first alternate frame lines during said generation of said first set of video scan lines and generates a second interlace frame signal for placing interpolation scan lines in second alternate frame lines during said repeat generation of said first set of video scan signals.

7. A video signal generator as claimed in claim 1, wherein:

said interpolation means further includes a picture element delay means for delaying said interpolation lines by one picture element period; and said interpolation means further sums and time integrates said at least one video attribute of said picture elements of video scan lines from said picture element delay means together with said video attributes of picture elements of video scan lines from said scan line generating means and said delay means.

8. A video signal generator as claimed in claim 1, wherein:

said interpolation means time integrates said at least one video attribute with a time constant of integration of approximately one third of said picture element period.

9. A video signal generator comprising:

a scan line generating means for repetitively generating video scan lines having a predetermined scan line period and including a plurality of picture elements, each picture element having a predetermined picture element period and at least one video attribute;

a first picture element delay means connected to said scan line generating means for delaying video scan lines for one picture element period;

a scan line delay means connected to said scan line generating means for delaying scan lines for one scan line period;

a second picture element delay means connected to said scan line delay means for delaying video scan lines from said scan line delay means for one picture element period;

an interpolation means connected to said scan line generating means, said scan line delay means and said first and second picture element delay means for repetitively generating interpolation scan lines by generating picture elements having at least one video attribute formed by summing and time integrating said at least one video attribute of picture elements of video scan lines received from said scan line generating means, said first picture element delay means, said scan line delay means and said second picture element delay means; and a video signal combining means connected to said scan line generating means and said interpolation means for generating a video signal including said video scan lines and said interpolation scan lines.

10. A video signal generator as claimed in claim 9, wherein:

said scan line generating means generates a first set of a predetermined number of video scan lines corresponding to a single video frame and then repeats generation of said first set of video scan lines; and said video signal combining means generates a first interlace frame signal for placing said first set of video scan lines in first alternate frame lines during said generation of said first set of video scan lines and generates a second interlace frame signal for placing interpolation scan lines in second alternate frame lines during said repeat generation of said first set of video scan signals.

11. A video signal generator comprising:

a scan line generating means for repetitively generating video scan lines having a predetermined scan line period and including a plurality of picture elements, each picture element having a predetermined picture element period and at least one video attribute;

a scan line delay means connected to said scan line generatingg means for delaying video scan lines for one scan line period;

an interpolation means connected to said scan line generating means and said scan line delay means for generating interpolation scan lines, said interpolation means including summing means for summing the vido attributes of video scan lines and delayed scan lines from said scan line delay means, summing integrator means having a first input connected to the output of said summing means, a second input and an output which is an integral over a time interval approximating the picture element period of video attributes, said output being said interpolation lines and a picture element delay means having an input connected to the output of said summing integrator means and an output which is delayed one picture element period connected to said second input of said summing integrator means; and a video signal combining means connected to said scan line generating means and said interpolator means for generating a video signal including said video scan lines and said interpolation scan lines.

12. A video signal generator as claimed in claim 11, wherein:

said scan line generating means generates a first set of a predetermined number of video scan lines corresponding to a single video frame and then repeats generation of said first set of video scan lines; and said video signal combining means generates a first interlace frame signal for placing said first set of video scan lines in first alternate frame lines during said generation of said first set of video scan lines and generates a second interlace frame signal for placing interpolation scan lines in second alternate frame lines during said repeat generation of said first set of video scan signals.

13. A video signal generator comprising:

a scan line generating means for repetitively generating video scan lines having a predetermined scan line period and including a plurality of picture elements, each picture element having a predetermined picture element period and at least one video attribute;

a delayed scan line generating means for repetitively generating delayed video scan lines corresponding to said video scan lines generated by said scan line generating means delayed by one scan line period;

an interpolation means connected to said scan line generating means and said delayed scan line generating means for repetitively generating interpolation scan lines by generating picture elements having at least one video attribute formed by combining said at least video attribute of a picture element of a video scan line and said at least one video attribute of a corresponding picture element of a delayed video scan line from said delayed scan line generating means; and a video signal combining means connected to said scan line generating means and said interpolation means for generating a combined video signal including said video scan lines and said interpolation scan lines.

14. A video signal generator as claimed in claim 13, wherein said at least one video attribute includes brightness.

15. A video signal generator as claimed in claim 14, wherein:

said at least one video attribute further includes a first color difference signal and a second color difference signal; and said interpolation means repetitively generates interpolation scan lines by separately summing and time integrating said brightness, said first color difference signal and said second color difference signal of a picture element of video scan lines from said scan line generating means and a corresponding picture element of video scan lines from said delay means.

16. A video signal generator as claimed in claim 13, wherein said at least one video attribute includes at least one primary color intensity.

17. A video signal generator as claimed in claim 16, wherein:

said at least one primary color intensity includes a first primary color intensity, a second primary color intensity and a third primary color intensity, and said interpolation means repetitively generates interpolation scan lines by separately summing and time integrating said first primary color intensity, said second primary color intensity and said third primary color intensity on a picture element of video scan lines from said scan line generating means and a corresponding picture element of video scan lines of said delay means.

18. A video signal generator as claimed in claim 13, wherein:

said scan line generating means generates a first set of a predetermined number of video scan lines corresponding to a single video frame and then repeats generation of said first set of video scan lines; and said video signal combining means generates a first interlace frame signal for placing said first set of video scan lines in first alternate frame lines during said generation of said first set of video scan lines and generates a second interlace frame signal for placing interpolation scan lines in second alternate frame lines during said repeat generation of said first set of video scan signals.

19. A video signal generator as claimed in claim 13, wherein:

said interpolation means further includes a picture element delay means for delaying said interpolation lines by one picture element period; and said interpolation means further sums and time integrates said at least one video attribute of said picture elements of video scan lines from said picture element delay means together with said video attributes of picture elements of video scan lines from said scan line generating means and said delay means.

20. A video signal generator as claimed in claim 13, wherein:

said interpolation means time integrates said at least one video attribute with a time constant of integration of approximately one third of said picture element period.

21. A video signal generator comprising:

a scan line generating means for repetitively generating video scan lines having a predetermined scan line period and including a plurality of picture elements, each picture element having a predetermined picture element period and at least one video attribute;

a first picture element delay means connected to said scan line generating means for delaying said video scan lines for one picture element period;

a delayed scan line generating means for repetitively generating delayed video scan lines corresponding to said video scan lines generated by said scan line generating means delayed by one scan line period;

a second picture element delay means conencted to said delayed scan line generating means for delaying said delayed video scan lines for one picture element period;

an interpolation means connected to said scan line generating means, said delayed scan line generating means and said first and secnd picture element delay means for repetitively generating interpolation scan lines by generating picture elements having at least one video attribute formed by combining said at least one video attribute of picture elements received from said scan line generating means, said first picture element delay means, said delayed scan line generating means and said second picture element delay means; and a video signal combining means connected to said scan line generating means and said interpolation means for generating a video signal including said video scan lines and said interpolation scan lines.

22. A video signal generator as claimed in claim 21, wherein:

said scan line generating means generates a first set of a predetermined number of video scan lines corresponding to a single video frame and then repeats generation of said first set of video scan lines; and said video signal combining means generates a first interlace frame signal for placing said first set of video scan lines in first alternate frame lines during said generation of said first set of video scan lines and generates a second interlace frame signal for placing interpolation scan lines in second alternate frame lines during said repeat generation of said first set of video scan signals.

23. A video signal generator comprising:

a scan line generating means for repetitively generating video scan lines having a predetermined scan line period and including a plurality of picture elements, each picture element having a predetermined picture element period and at least one video attribute;

a delayed scan line generating means for repetitively generating delayed video scan lines corresponding to said video scan lines generated by said scan line generating means delayed by one scan line period;

an interpolation means connected to said scan line generating means and said delayed scan line generating means for generating interpolation scan lines, said interpolation means including summing means for summing said at least one video attribute of said video scan lines and said delayed video scan lines from said delayed scan line generating means, summing integrator means having a first input connected to the output of said summing means, a second input and an output which is the integral over a time period approximating the picture element period of the sum of said video attributes of the signals applied to said first and second inputs, said output being said interpolation scan lines and a picture element delay means having an input connected to the output of said summing integrator means and an output which is delayed one picture element period connected to the second input of said summing integrator means; and a video signal combining means connected to said scan line generating means and said interpolation means for generating a video signal including said video scan lines and said interpolation scan lines.

24. A video signal generator as claimed in claim 17, wherein:

said scan line generating means generates a first set of a predetermined number of video scan lines corresponding to a single video frame and then repeats generation of said first set of video scan lines; and said video signal combining means generates a first interlace frame signal for placing said first set of video scan lines in first alternate frame lines during said generation of said first set of video scan lines and generates a second interlace frame signal for placing interpolation scan lines in second alternate frame lines during said repeat generation of said first set of video scan signals.

* * * * *